US006061992A

United States Patent [19]

Vincent

[11] Patent Number: 6,061,992

[45] Date of Patent: May 16, 2000

[54] COMPOSITE STEEL/CONCRETE COLUMN

[75] Inventor: Richard Vincent, Pointe-Claire, Canada

[73] Assignee: Le Groupe Canam Manac Inc., Boucherville, Canada

[21] Appl. No.: 09/078,492

[22] Filed: May 14, 1998

[30] Foreign Application Priority Data

May 15, 1997 [CA] Canada ..... 2206830

[51] Int. Cl.[7] ..... E04C 3/34

[52] U.S. Cl. ..... 52/721.3; 52/729.2; 52/730.2; 52/736.1; 52/737.1; 52/745.17

[58] Field of Search ..... 52/250, 260, 721.2, 52/721.3, 721.4, 721.5, 729.1, 729.2, 730.2, 745.17, 736.1, 737.1

[56] References Cited

U.S. PATENT DOCUMENTS

| | | | |
|---|---|---|---|
| 915,295 | 3/1909 | Himmelwright . | |
| 918,643 | 4/1909 | Aylett et al. . | |
| 1,813,118 | 7/1931 | Edwards et al. . | |
| 1,837,088 | 12/1931 | Watson | 52/729.1 |
| 1,911,413 | 5/1933 | Wait | 52/729.1 |
| 2,074,320 | 3/1937 | Bauer . | |
| 2,083,055 | 6/1937 | Coddington . | |
| 2,618,148 | 11/1952 | Reed . | |
| 2,844,023 | 7/1958 | Maiwurm . | |
| 2,912,849 | 11/1959 | Wissinger . | |
| 3,050,161 | 8/1962 | Shlager . | |
| 3,147,571 | 9/1964 | Welch . | |
| 3,267,627 | 8/1966 | Hammitt . | |
| 3,300,912 | 1/1967 | Shumaker . | |
| 3,516,213 | 6/1970 | Sauer . | |
| 3,590,547 | 7/1971 | Molyneux . | |
| 3,798,867 | 3/1974 | Starling . | |
| 3,890,750 | 6/1975 | Berman et al. . | |
| 3,916,592 | 11/1975 | Morohashi et al. . | |
| 3,938,294 | 2/1976 | Gaburri . | |
| 4,128,980 | 12/1978 | Abdallah . | |
| 4,196,558 | 4/1980 | Jungbluth . | |
| 4,407,106 | 10/1983 | Beck . | |
| 4,571,913 | 2/1986 | Schleich et al. . | |
| 4,616,464 | 10/1986 | Schleich et al. | 52/721.4 |
| 4,722,156 | 2/1988 | Sato . | |
| 4,779,395 | 10/1988 | Schleich et al. . | |
| 4,783,940 | 11/1988 | Sato et al. . | |
| 5,012,622 | 5/1991 | Sato et al. . | |
| 5,119,614 | 6/1992 | Rex . | |
| 5,410,847 | 5/1995 | Okawa et al. . | |
| 5,680,738 | 10/1997 | Allen et al. | 52/729.1 |

FOREIGN PATENT DOCUMENTS

| | | | |
|---|---|---|---|
| 5-141042 | 6/1993 | Japan | 52/721.2 |
| 5-230879 | 9/1993 | Japan | 52/721.1 |
| 1264302 | 2/1972 | United Kingdom | 52/721.4 |
| WO 92/08018 | 5/1992 | WIPO . | |

*Primary Examiner*—Beth Aubrey
*Assistant Examiner*—Brian E. Glessner
*Attorney, Agent, or Firm*—Gilberto M. Villacorta; Suresh Koshy; Pepper Hamilton LLP

[57] ABSTRACT

The composite steel/concrete column comprises a longitudinally extending H-shaped steel assembly having a pair parallel flange plates and a web plate interconnecting the flange plates and defining two opposite channel-shaped spaces. A plurality of spaced-apart transversal tie bars are disposed along the steel assembly on each side of the web plate for interconnecting the flange plates. A mass of concrete is filling the channel-shaped spaces. The column steel concrete column is characterized in that the ratio of the cross-sectional surface area of the steel assembly with respect to the total surface area of the composite steel/concrete column is less than 9%, preferably 2% to 5%. The column is principally to be utilized in structural steel high-rise buildings which have the advantage of shop prefabrication resulting in rapid on site construction. The column shows a steel to concrete ratio greatly reduced as compared to prior art composite columns, thereby greatly reducing the production cost and the size of the column and also greatly reducing its construction time.

11 Claims, 5 Drawing Sheets

COMPOSITE STEEL/CONCRETE COLUMN

RELATED APPLICATIONS

This patent application claims priority from Canadian patent application number 2,206,830, filed May 15, 1997 which is incorporated herein by reference, including all references cited therein.

FIELD OF THE INVENTION

The present invention relates to a composite steel and concrete structure and in particular to high-rise column constructions designed to resist primarily axial loads resulting from gravity loads or a combination of gravity loads and axial loads resulting from wind or seismic forces. The column is principally to be utilized in structural steel high-rise buildings which have the advantage of shop prefabrication resulting in rapid on site construction.

BACKGROUND OF THE INVENTION

Composite steel/concrete columns which can withstand very important tensile and compressive forces are already known in prior art. Thus it is already known to fill a tube or the free space of an H-shaped steel beam with concrete to increase its compression strength. Such columns are described in U.S. Pat. Nos. 3,050,161 and 4,196,558.

Also known in prior art, there are fire-resistant concrete and steel structural elements which comprise a steel beam covered with concrete to increase the fire resistance of the steel. Examples of such prior art beams are given in U.S. Pat. Nos. 3,516,213; 4,571,913 and 4,779,395.

The following documents are other examples of prior art steel/concrete columns: U.S. Pat. Nos. 915,295; 918,643; 1,813,118; 2,618,148; 2,844,023; 2,912,849; 3,147,571; 3,267,627; 3,300,912; 3,590,547; 3,798,867; 3,890,750; 3,916,592; 3,938,294; 4,128,980; 4,407,106; 4,722,156; 4,783,940; 5,012,622; 5,119,614 and 5,410,847.

A drawback commonly experienced with the known high strength composite steel/concrete columns is that the steel portion of the column which is obtained from a single steel section is still very important as compared to the concrete portion rendering such column not very interesting as far as prices are concerned. Another drawback with such heavy steel sections used with prior art composite columns is that heavy and costly equipment is required to erect those sections on the construction site, as the sections are not easy to manipulate due to their heavy weight.

OBJECTS OF THE INVENTION

An object of the present invention is to provide an improved steel concrete column that will overcome the above mentioned drawbacks. More particularly, an object of the present invention is to propose a high strength steel/concrete column that shows a steel to concrete ratio greatly reduced as compared to prior art composite columns, thereby greatly reducing the production cost and the size of the column, and also reducing the size and cost of the lifting equipment necessary to install the column.

SUMMARY OF THE INVENTION

In accordance with the present invention, these above-mentioned objects are achieved with a composite steel/concrete column comprising:

a longitudinally extending H-shaped steel assembly having a given cross-sectional surface area and comprising a pair of substantially parallel flange plates and a web plate interconnecting the flange plates and defining two opposite channel-shaped spaces;

a plurality of spaced-apart transversal tie bars disposed along the steel assembly on each side of the web plate, each tie bar interconnecting the flange plates; and a mass of concrete filling the channel-shaped spaces. The composite steel/concrete column is characterized in that the ratio of the cross-sectional surface area of the steel assembly with respect to a total surface area of the composite steel/concrete column is less than 9%, preferably 2% to 5%.

The present invention also relates to a method of building a steel/concrete column having a given cross-sectional surface area and wherein the steel has a cross-sectional surface area representing less than 9% of the cross-sectional surface area of the column, the method comprising the following consecutives steps of:

a) erecting a bare steel column comprising:
   - a longitudinally extending steel assembly including a pair of substantially parallel flange plates and a web plate interconnecting the flange plates and defining two opposite channel-shaped spaces; and
   - a plurality of transversal tie bars disposed along the steel assembly on each side of the web plate, each tie bar interconnecting the flanges;

b) providing formwork for longitudinally closing the channel-shaped spaces;

c) pouring a mass of concrete into the channel-shaped spaces; and d) stripping the formwork.

The steel assembly is prefabricated from three relatively thin steel plates into a substantially "H" configuration. The steel portion of the column is designed to resist all the construction dead and live loads as well as a portion or all of the permanent dead loads and possibly some live load. The remaining permanent dead loads as well as the live loads are to be resisted by the composite steel—concrete column.

BRIEF DESCRIPTION OF THE DRAWINGS

This invention will now be described with reference to the accompanying drawings in which only one preferred embodiment is shown.

DESCRIPTION OF A PREFERRED EMBODIMENT

Figure 1:
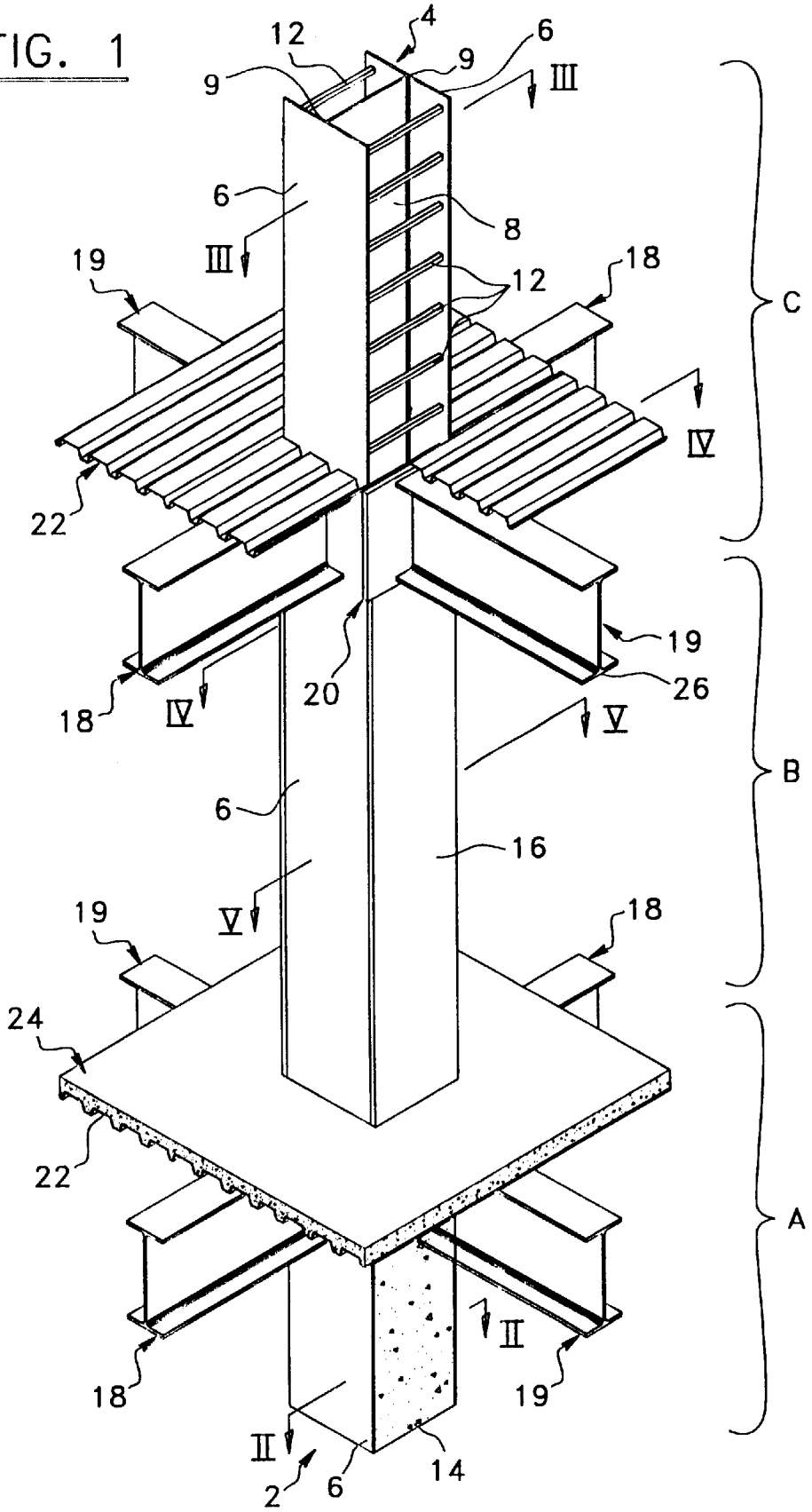
FIG. 1 is a perspective view of a steel/concrete column according to a preferred embodiment of the present invention over a three storey section of a typical high-rise building in various phases of advancement during on site construction.
Figure 2:
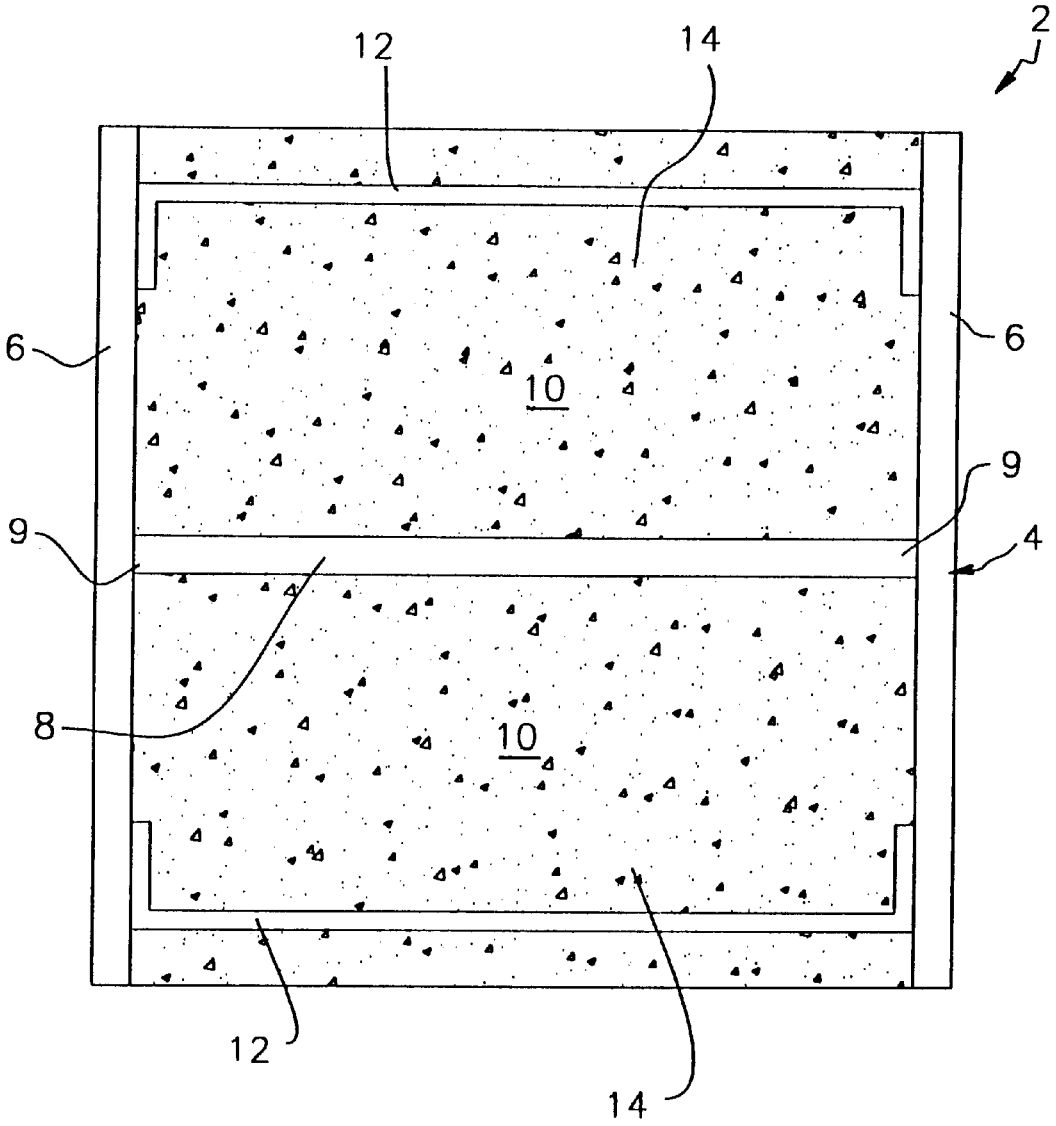
FIG. 2 is a cross-sectional top view of the composite steel/concrete column taken along line II—II of FIG. 1, after the concrete has been poured and the formwork removed.

Referring to FIGS. 1 and 2, a composite steel/concrete column (2) according to a preferred embodiment of the present invention comprises a longitudinally extending H-shaped steel assembly (4) comprising a pair of substantially parallel flange plates (6) and a web plate (8) interconnecting the flange plates (6) and defining two opposite channel-shaped spaces (10). Each flange plate (6) is preferably welded to a respective end (9) of the web plate (8). A plurality of spaced-apart transversal tie bars (12) is disposed along the steel assembly (4) on each side of the web plate (8). Each tie bar (12) interconnects and supports the flange plates (6). Preferably, each of the tie bars (12) is interconnecting the flange plates (6) near an outside edge of said plates (6). As best shown in FIG. 1, the tie bars (12) are preferably regularly spaced along the column (2) to provide a uniform support.

A mass of concrete (14) is filling the channel-shaped spaces (10). The ratio of the cross-sectional surface area of the steel assembly (4) with respect to the total surface area of the composite steel/concrete column (2) is less than 9%, preferably 2% to 5%. A conventional composite column which comprises a H-shaped steel section obtained and formed from a single steel bar and wherein the flanges and the web are integral to each other does not show such a low ratio of steel therein.

It has been discovered that by using a steel assembly (4) designed with independent thin plate sections, namely the flange plates (6) and the web plate (8), it was possible to obtain such low ratio without lowering too much the axial strength of the steel assembly (4). More particularly, the steel assembly (4) is a shop welded three plate section, as shown in FIG. 2, and is fabricated from relatively thin flange plates (6) and a relatively thin web plate (8). The flange plates (6) are supported near their outside tips by the tie bars (12), which are welded to the column flange plates (6) and spaced at approximately equal intervals along the height of the column. The tie bars (12) may be made of round or flat bar shapes or of reinforcing bar steel.

The built up section is similar in shape to a conventional hot rolled shape except that the properties and behavior of the section are significantly different. The width to thickness ratios of the flanges (6) and web (8) are significantly greater than for a hot rolled shape or even of a three plate built up section exceeding by one and a half to five times the normal limit. This limit for flanges is defined as $95/(F_y)^{0.5}$ in the American Institute of Steel Construction's "Specification for Structural Steel Buildings" and "Load and Resistance Factor Design Specification for Structural Steel Buildings", where $F_y$ is the specified yield strength of the steel. The limit for webs is $257/(F_y)^{0.5}$ and $253/(F_y)^{0.5}$ respectively for the same codes. The width to thickness ratios are of the magnitude to make the section unpractical for normal construction as the flanges would buckle prematurely at a very low stress. The tie bars (12) are added between the flanges (6) along the length of the column and located close to the edges of the flanges (6) to increase the buckling strength of the section. These new column sections are so designed so that the total area enclosed by the steel section contains only between two and five percent steel area. This sets the concrete to steel ratio of the composite column at between 19 to 49. The percentage of steel area to enclosed area of a conventional high rise hot rolled column is between 9% and 54% and usually greater for three plate built up high-rise columns. The aim of this invention is to use as small an area of steel column as feasibly possible while building a steel high-rise building using the steel/concrete column.

As mentioned before, the tie bars (12) act as flange support ties for the steel section prior to pouring of the concrete (14). They prevent lateral buckling of the thin flange plates (6) and greatly enhance the load carrying capacity of the bare steel column (4).

Figure 3:
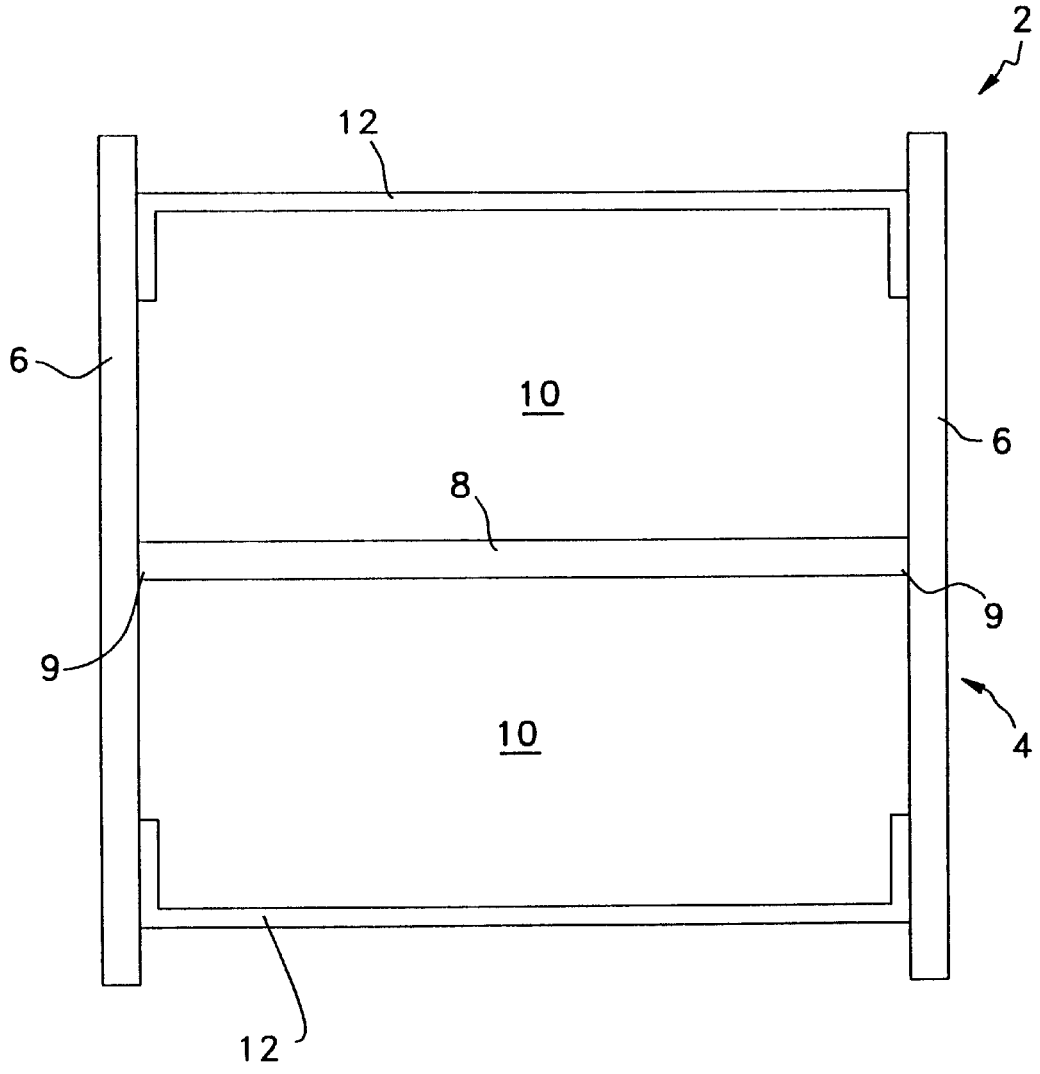
FIG. 3 is a cross-sectional top view of the steel assembly of the column shown in FIG. 1, taken along line III—III between floors of the typical high-rise building before the concrete has been poured and the formwork has been installed.

The tie bars (12) also act as lateral ties for the concrete (14), providing confinement to the concrete (14) on the open face while the concrete (14) is completely confined on the three other sides by the flanges (6) and web (8) of the steel assembly (4). This confinement increases the axial capacity of the concrete portion (14) of the composite column (2). The tie bars (12) can be made from standard flat or round bars or reinforcing bars. The ends of the bars (12) can be welded directly to the inside face of the column flange (6). Alternatively, as shown in FIGS. 2 and 3, the bar ends can be bent at 90° to the bar (12) and this end positioned toward the web (8) of the column (2) and perpendicular to the column axis and these bar ends welded to the inside face of the column flange (6).

As mentioned hereinbefore the present invention also relates to a method of building a steel/concrete column (2) as previously described. The method comprises the following consecutives steps of:

a) erecting a bare steel column consisting of a longitudinally extending steel assembly (4) described hereinbefore;

b) providing formwork (16) for longitudinally closing the channel-shaped spaces (10);

c) pouring a mass of concrete (14) into the channel-shaped spaces (10); and d) stripping the formwork (16).

Figure 5:
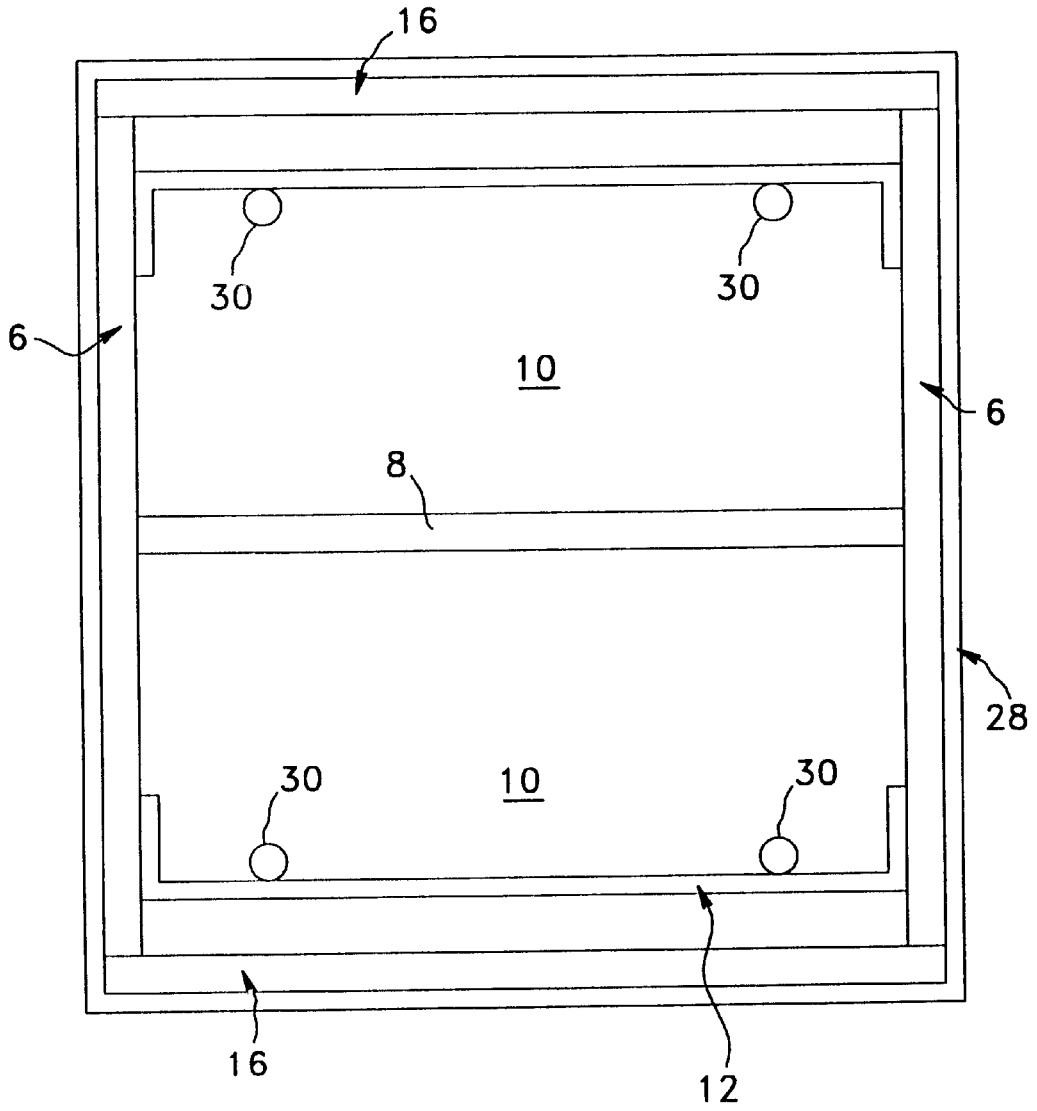
FIG. 5 is a cross-sectional top view of the steel assembly taken along line V—V of FIG. 1 between floors of a typical high-rise building with formwork in place and before the concrete has been poured.

Referring more particularly to FIG. 1, the composite steel-concrete column (2) is shown after the concrete (14) has been poured and the formwork (16) stripped in the lower level (A) of the three storey view. In the middle level (B), the steel assembly (4) with plywood formwork (16) is shown prior to the pouring of the concrete (14) in the channel-shaped spaces or column cavity created between the flanges (6) and web (8) of the steel assembly (4) and the formwork (16), as illustrated in FIG. 5. In the upper level (C), the steel assembly (4) is shown in the shop fabricated state, as illustrated in FIG. 3. Typical floor beams (18) are shown framing into the flanges (6) of the steel column assembly (4). The standard floor beam to column flange connection has not been shown for clarity. Typical floor beams (19) or other types of floor supporting members such as trusses or joists (not illustrated) framing into the web side (8) of the column assembly (4) are connected to a steel connection plate (20). Once again, the standard connection between the beam (19) and the connection plate (20) has not been shown for clarity. A typical steel floor deck (22) is shown supporting the concrete floor slab (24) which acts as the finished floor for the middle level (B). The tie bars (12) can be seen in the steel assembly (4) of the upper level (C).

Figure 4:
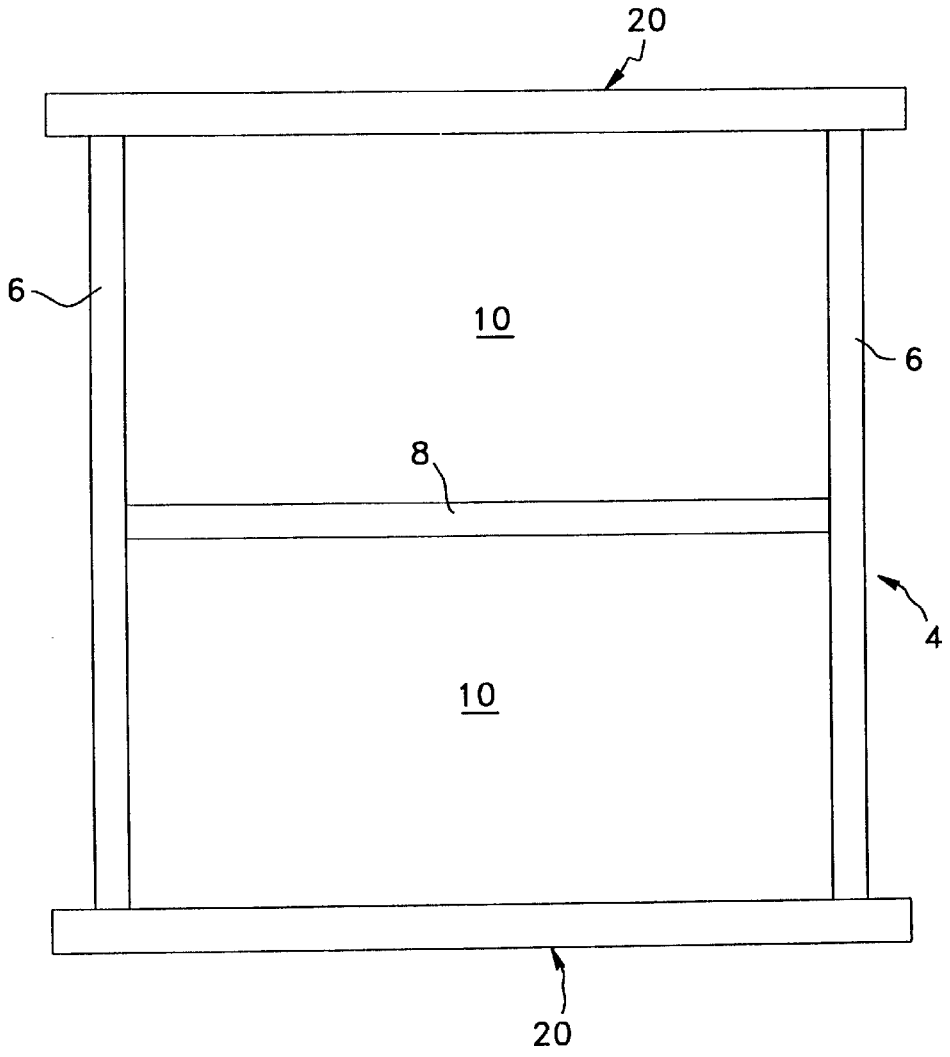
FIG. 4 is a cross-sectional top view of the steel assembly of FIG. 1 taken along line IV—IV at a typical floor level of the high-rise steel building before the concrete has been poured.

Referring to FIG. 4, a steel connection plate (20) is shop welded to the toes or edges of the column flanges (6) to facilitate the connections for the floor members (19) framing into the web (8) of the column assembly (4) at the floor level. As best seen in FIG. 1, the connection plate (20) preferably projects below the bottom flange (26) of the floor framing member (19) to facilitate the placing and removal of the formwork (16).

Referring to FIG. 5, the formwork (16), depicted as plywood sheeting in this figure, can be of any material which can resist the concrete pouring loads. Strapping (28) or any suitable attachment can be used to support the plywood (16) in place and to make it easily removable. Vertical reinforcing steel bars (30) are preferably added to increase the concrete confinement and carry additional vertical load.

As can be appreciated from FIG. 1, the steel plate connections (20) welded to the toes of the column flanges (6) allow conventional steel connections to be made for the floor members framing (19) directly into the column assembly (4). This plate connection (20) becomes the permanent formwork during the pouring of the concrete in situ which creates the composite column (2).

Simple plywood or similar formwork boards (16) are required to enclose the area surrounded by the toes of the column flanges (6) and the web (8) of the column assembly (4). The height of the formwork (16) need only to span from the finished floor slab (24) below to the underside of the steel connection plate (20) of the next floor level above, as shown in FIG. 1.

The concrete (14) in the column (2) is poured from the floor above, through the channel-shaped spaces (10), in other words, the openings created between the steel plate connections (20) or the formwork (16) and the area between the web (8) of the steel column assembly (4) and the tips of the flanges (6). The concrete (14) is poured in the same sequence as the concrete for the floor directly above the column.

As can be appreciated, the concrete (14) acts as a heat sink during a fire and protects the steel portion of the column (2) from buckling prematurely, thereby achieving a fire-rating without the need of additional fire protection.

Shear connectors may be located on the inside faces of the flanges (6) and steel connector plates (20) as well as the web (8) of the steel column assembly (4) to distribute the axial load between the concrete (14) and the steel portions (4) of the composite column (2). Advantageously, a steel/concrete composite column according to the present invention allows a structural high-rise building to be built very rapidly at a relatively low cost. The erection of a high-rise building implies that the columns be able to resist very important axial loads.

The prefabricated steel assembly is mainly devised to withstand axial loads during the building erecting phase of the building. As the steel portion is very reduced as compared to prior art composite columns, the size of lifting equipment required for erecting the steel assemblies is greatly reduced, and smaller and faster cranes can be used. Therefore, many floor levels can be rapidly erected. The axial strength of the column is then increased by pouring the concrete in the channel-shaped spaces of the steel assembly.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What is claimed is:

1. A composite steel/concrete column comprising:

a longitudinally extending H-shaped steel assembly formed from a pair of substantially parallel flange plates and a web plate interconnecting the flange plates and defining two opposite channel-shaped spaces, the steel assembly having a given cross-sectional surface area;

a plurality of spaced-apart transversal tie bars disposed along the steel assembly on each side of the web plate, each tie bar interconnecting the flange plates;

a mass of concrete filling the channel-shaped spaces; and the ratio of the cross-sectional surface area of the steel assembly with respect to a total surface area of the composite steel/concrete column is less than 9%.

2. A composite steel/concrete column as claimed in claim 1, wherein the ratio of the cross-sectional surface area of the steel assembly with respect to the total surface area of the composite steel/concrete column is 2% to 5%.

3. A composite steel/concrete column as claimed in claim 2, wherein each flange plate is welded to a respective end of the web plate.

4. A composite steel/concrete column as claimed in claim 3, wherein each of the tie bars are interconnecting the flange plates near an outside edge of said flange plates.

5. A composite steel/concrete column as claimed in claim 4, wherein each tie bar is welded to the flange plates.

6. A composite steel/concrete column as claimed in claim 5, wherein the tie bars are substantially, longitudinally and regularly spaced along the column.

7. A composite steel/concrete column as claimed in claim 2, wherein the width to thickness ratio of the flange plates of the steel assembly exceeds by one and a half to five times a normal limit defined as $95/(F_y)^{0.5}$ where $F_y$ is the yield strength of the steel.

8. A composite steel/concrete column as claimed in claim 7, wherein the width to thickness ratio of the web plate of the steel assembly exceeds by one and a half to five times a normal limit defined as approximately $257/(F_y)^{0.5}$.

9. A composite steel/concrete column as claimed in claim 8, further comprising longitudinally extending reinforcing bars embedded in the mass of concrete.

10. A method of building a steel/concrete column having a given cross-sectional surface area and wherein the steel has a cross-sectional surface area representing less than 9% of the cross-sectional surface area of the column, the method comprising the following consecutive steps of:

a) erecting a bare steel column comprising:

a longitudinally extending H-shaped steel assembly formed from a pair of substantially parallel flange plates and a web plate interconnecting the flange plates and defining two opposite channel-shaped spaces; and a plurality of transversal tie bars disposed along the steel assembly on each side of the web plate, each tie bar interconnecting the flanges, b) providing formwork for longitudinally closing the channel-shaped spaces;

c) pouring a mass of concrete into the channel-shaped spaces; and d) stripping the formwork.

11. A method as claimed in claim 10, wherein the ratio of the cross-sectional surface area of the steel assembly with respect to the total surface area of the steel/concrete column is 2 to 5%.

* * * * *